US006967004B2

(12) United States Patent
Rainin et al.

(10) Patent No.: US 6,967,004 B2
(45) **Date of Patent: *Nov. 22, 2005**

(54) PIPETTE WITH IMPROVED PIPETTE TIP AND MOUNTING SHAFT

(75) Inventors: Kenneth Rainin, Piedmont, CA (US); James S. Petrek, Danville, CA (US); Steven T. Nielsen, Los Gatos, CA (US)

(73) Assignee: Rainin Instrument, LLC, Oakland, CA (US)

( * ) Notice: Subject to any disclaimer, the term of this patent is extended or adjusted under 35 U.S.C. 154(b) by 490 days.

This patent is subject to a terminal disclaimer.

(21) Appl. No.: 10/000,688

(22) Filed: Oct. 30, 2001

(65) Prior Publication Data

US 2003/0082078 A1 May 1, 2003

(51) Int. Cl.[7] ..... B01L 3/02

(52) U.S. Cl. ..... 422/100; 73/864.14; 73/864.16; 73/864.18

(58) Field of Search ..... 422/100; 436/180; 73/864.14, 864.16, 864.18

(56) References Cited

U.S. PATENT DOCUMENTS

| | | | | |
|---|---|---|---|---|
| 4,824,641 | A * | 4/1989 | Williams | 422/100 |
| 4,863,695 | A * | 9/1989 | Fullemann | 422/100 |
| 6,171,553 | B1 * | 1/2001 | Petrek | 422/100 |
| 6,568,288 | B2 * | 5/2003 | Rainin et al. | 73/864.16 |
| 6,745,636 | B2 * | 6/2004 | Rainin et al. | 73/864.16 |

* cited by examiner

*Primary Examiner*—Jan M. Ludlow
(74) *Attorney, Agent, or Firm*—Robert R. Meads

(57) ABSTRACT

A pipette tip and mounting shaft combination in an air displacement pipette, the combination comprising a pipette tip mounting shaft having a radially stepped exterior comprising adjacent substantially cylindrical portions of different diameter and an annular sealing zone including an annular edge seal at an outermost edge of a radially extending shaft transition, a pipette tip including an annular sealing region having an inner sealing surface on a sidewall of the tip which in the sealing region is sufficiently thin as to expand slightly and form an interference fit and air tight seal between the sealing surface and the sealing zone when the sealing zone penetrates the sealing region, and axial penetration limiting means for limiting penetration of the shaft into the tip to limit axial contact between the sealing region and the sealing zone to a narrow annular band comprising the annular edge seal.

17 Claims, 7 Drawing Sheets

PIPETTE WITH IMPROVED PIPETTE TIP AND MOUNTING SHAFT

BACKGROUND OF INVENTION

The present invention relates to improvements in pipettes and, more particularly, to air displacement pipettes including a novel mounting shaft and pipette tip tailored to each other such that the tip is easily insertable by a pipette user onto the shaft to a fluid tight position in which the tip is secured against undesired lateral rocking on or displacement from the shaft and, after use, is easily ejectable from the shaft by the pipette user; such tip insertion and ejection requiring the pipette user to only exert axial tip insertion and ejection forces of about one pound or less thereby substantially reducing the risk of repetitive motion injury to the pipette user.

The use of pipette devices for the transfer and dispensing of precise quantities of fluids in analytical systems is well known as is the use of disposable tip members for such pipettes. Disposable tips accommodate the serial use of such pipette devices in the transfer of different fluids without carryover or contamination.

Generally speaking, disposable pipette tips are formed of a plastic material and are of a hollow, elongated, generally conical shape with an open proximal end for receiving and releasably mating with the distal end of an elongated generally conical pipette tip mounting shaft of a pipette device. Ideally, the disposable tip should slide easily onto the mounting shaft to an axial position adjacent a lower end of a tip ejection mechanism of the pipette device. Thus located, the pipette tip should be laterally stable on the shaft, free from external rocking relative to the shaft (as during "touching off"), and should form a fluid tight annular seal with the mounting shaft. Then, when it is desired to replace the tip with a new tip, the pipette tip should be easily removed from the mounting shaft by operation of the tip ejection mechanism.

To meet the desired sealing criteria for disposable pipette tips on pipette tip mounting shafts, the inner surface and side walls of the proximal portions of most pipette tips are axially tapered at a one to one and a half degree greater angle than the distal end of the pipette tip mounting shaft and form an axially elongated frusto-conical annular sealing band. The sealing band is dimensioned to stretch outwardly ("hoop stretch") as the distal end of the elongated generally conical pipette tip mounting shaft is forced into the proximal end of the tip to firmly seat the tip on the shaft and to create an axially elongated annular fluid tight seal between the sealing band and the mounting shaft. Other pipette tips, such as those described in U.S. Pat. Nos. 4,748,859 and 4,824,641, include a plurality of axially spaced compressible annular sealing rings on an inner surface of the proximal end portion of such tips. The rings create multiple axially spaced fluid tight annular seals between the outer surface of the pipette tip mounting shaft and the inner surface of the proximal end portion of the tip which by virtue of the axially spaced rings is laterally stabilized against undesired rocking on the shaft during touching off.

Usually, in mounting a pipette tip on a mounting shaft of a pipette, a user, exerting a downward force of between eight and fifteen pounds, drives the mounting shaft axially into the tip a distance which to the user seems sufficient to create (i) a fluid tight seal between the tip and (ii) the desired lateral stability for the tip on the shaft. On occasion, in a mistaken attempt to enhance the fluid tight seal and/or to improve the lateral stability of a pipette tip on a mounting shaft, a user will exert a downward insertion force (e.g. eighteen to twenty pounds) on the shaft sufficient to axially drive the tip on the shaft until an upper surface of the tip engages or is wedged into the ejector arm or cone of the tip ejector mechanism of the pipette. The contact between a lower surface of the tip ejector arm or cone and the upper surface of the tip, however, does little to improve the fluid tight seal and only provides a minimal resistance to rocking of the tip on the shaft and hence only results in a minimal increase in the lateral stability of the tip on the shaft. Further, since most pipette tips are formed of a relatively rigid plastic material, the annular stretching of the pipette tip required to accommodate movement of the tip onto the shaft particularly to a point where it engages the lower surface of the tip ejector or cone is difficult to achieve. In fact, the axial forces which must be exerted on a conventional pipette to achieve such a positioning of the tip on the pipette tip mounting shaft frequently exceed twelve and may be as great as twenty pounds, which is difficult for many pipette tip users to generate. Of course, with most pipette tip designs, the greater the axial force exerted in seating a pipette tip on a pipette mounting shaft, the greater the force required to eject the tip from the mounting shaft. Thus, while the insertion of a pipette tip onto a mounting shaft until it reaches a position against a lower surface of a pipette tip ejector mechanism provides a minimum increase in the lateral stability of the tip on the shaft, it works against the design criteria for disposable pipette tips that they be easily removable from the shaft when it is desired to replace the tip.

In fact, the design criteria for disposable pipette tips that they be stably mountable on and form a fluid tight seal with a pipette mounting shaft is more easily achieved than the design criteria that disposable pipette tips slide easily onto a pipette tip mounting shaft to an axial location forming a fluid tight seal and then be easily removable from the mounting shaft when it is desired to replace the tip.

In these regards, the pipette tip mounting shafts of devices for pipetting volumes of liquid in different ranges have different external shape. For example, the distal end of standard pipette tip mounting shafts of pipettes for pipetting liquids in volumes greater than 500 microliters (large volume pipettes) commonly have a downward and inward axial taper of about one and one half to two and one half degrees per side from the longitudinal axis of the mounting shaft. On the other hand, the distal end of the mounting shafts of moderate to relatively small volume pipette devices (250 microliters and less) commonly have a downward and inward axial taper of about two to five degrees per side from the longitudinal axis of the mounting shaft so that the nose of the shaft will hit the inner wall of the pipette tip and cause hoop stretching thereof before the side of the shaft engages the inner wall of the tip. Therefore, while the design criteria that a large volume pipette tip be easily mountable on and easily removable from the mounting shaft of a large volume pipette device may be achieved by including a proximal end portion having a side wall of reduced wall thickness as in the large volume pipette tip described in U.S. Pat. No. 5,779,984, issued Jul. 14, 1998, such a thin wall design will not result in a pipette tip that satisfies the easy mount and ejection design criteria of moderate and small volume pipette tips which must firmly mount on pipette tip mounting shafts having an inward taper of two degrees and above. The same is true of the pipette tip design disclosed in U.S. Pat. Nos. 4,072,330 and 4,961,350 which include broad frusto-conical sealing regions having thin side walls for mating with axially broad conically tapered or spherically convex collars extending outward and spaced some distance from distal ends of associated pipette tip mounting shafts.

As previously stated, standard small and moderate volume pipette tips include a frusto-conical annular sealing band or inner surface for engaging and sealing with the tapered distal end of a pipette tip mounting shaft. The angle of taper of the sealing surface usually approximates (e.g. one and one-half degrees greater than) that of the mounting shaft (e.g. two to five degrees). Thinning the side wall of the standard small and moderate volume pipette tips in the region of such a sealing band does little to reduce the mounting and ejection forces required to move such a tip to a sealing location and then eject the pipette tip from the mounting shaft. In forming the desired annular seal, the frusto-conical annular region is required to stretch like a hoop (hoop stretch) outwardly normal to the mating sloping surface of the pipette tip mounting shaft. Large reactive forces in the tip material resist such hoop stretching and require the exertion of large axial forces (e.g. ten or more pounds) on the tip in order to mount the tip on the mounting shaft and create the necessary annular fluid tight seal. Such reactive forces increase as the tip is driven toward the tip ejection mechanism of the associated pipette device.

Further, disposable pipette tips are commonly mounted and stored in sterilizable racks. Such racks commonly include a support tray having an array of holes for receiving distal ends of pipette tips to vertically orient the pipette tips in a spaced rectilinear pattern with open proximal ends of the tips exposed to receive the mounting shafts of a pipette device onto which the pipette tips are to be mounted. For example, to mount the disposable pipette tips contained in a tip rack on the shafts of a multi-channel pipette, the pipette device is placed over the rack with its several mounting shafts aligned with the open proximal ends of an aligned series of the pipette tips. After a slight initial insertion of the mounting shafts into the open proximal ends of the aligned pipette tips, a relatively large downward force is exerted on the pipette device to drive the mounting shafts into the tip members. The pipette tips are thus very firmly seated on the mounting shafts and are lifted from the rack with upward movement of the multi-channel pipette. Unfortunately, in practice, such multiple pipette tip mounting procedures often result in some of the pipette tips being mounted at different axial locations on some of the mounting shafts. In an attempt to eliminate such non-uniform mounting of pipette tips on the several channels of a multi channel pipette, users often rock the pipette as the mounting shafts are driven by axial forces approximating 12 to 15 pound per channel into the tips supported by a pipette tip rack to drive the tips toward the lower surface of the tip ejector mechanism of the pipette. Also, it is frequently necessary to hand tighten each pipette tip on its associated mounting shaft to prevent undesired fluid leakage from the tips.

Moreover, the more firmly a tip is mounted or wedged on the mounting shaft of the pipette device, the greater the axial force which a pipette user must generate by thumb and hand action to eject the tip from the shaft when a tip replacement is desired. In practice, it is not uncommon for axial forces approximating twenty to twenty-five pounds to be generated by the pipette users thumb and hand in driving pipette tips from the mounting shafts of a multi-channel pipette. Over several and repeated ejection operations, particularly with multi-channel pipettes, the thumb and hand of the user become physically stressed often resulting in repetitive stress injury to the thumb and hand and in extreme cases, carpal tunnel syndrome.

Still further, standard pipette tips as well as those illustrated in U.S. Pat. No. 4,072,330 depend solely upon the sealing region of the pipette tip to both create the annular fluid tight seal and to provide the stable lateral mounting of the tip to the shaft sufficient to resist rocking as during touching off. The structure of such pipette tips do not provide such lateral mounting stability.

In an effort to improve lateral stability and retention of pipette tips on the mounting shafts of some pipettes, some manufacturers include O-rings on and encircling the tip mounting shafts of their pipettes. For example, the Brinkmann Instrument Co. indicates for its Transferpipette 8/12 that such O-rings ensure that all tips stay firmly mounted during use. However, there is a rapid wearing of such O-rings with repeated insertion of the associated mounting shafts into and ejection of pipette tips from such shafts. With such wear, the tips no longer stay firmly mounted during use and wear particles from the O-rings can contaminate fluid samples handled by the associated pipettes.

In an effort to reduce the hand and finger forces which a pipette user must generate to eject a tip from the mounting shaft of a pipette, other pipette manufacturers such as LabSystems have developed and include in some of their pipettes rack and gear mechanisms for amplifying the user generated forces to eject pipette tips from their mounting shafts. Unfortunately, such mechanisms are costly, add undesired size and weight to the pipettes and only achieve a force reduction of about 2 to 1.

More recently, to meet the previously described ideal characteristics and criteria for a pipette tip, there has been developed an improved plastic pipette tip which is mountable on and ejectable from a standard pipette mounting shaft of an air displacement pipette by application of an axial mounting force of less than six pounds and an axial ejection force as small as three pounds. The improved pipette tip is described in the U.S. Pat. No. 6,197,259, entitled "Easy Eject Pipette Tip", issued Mar. 6, 2001. As there described, to meet the mountability and ease of ejection criteria for disposable pipette tips, the improved pipette tip, hereinafter referred to as the "Soft Seal" tip, includes an open tubular proximal end portion comprising an enlarged frusto-conical open top tapering downwardly and inwardly to join at an annular sealing region to a hollow substantially cylindrical mid-portion of the pipette tip. The open top has an inner diameter sufficient to axially receive the distal end of a standard pipette tip mounting shaft. The annular sealing region is formed by the transition or line of connection of the frusto-conical open top to the mid-portion of the pipette and includes an annular sidewall having a thickness in a range of 0.20 to 0.50 mm. The mid-portion has an inner diameter at the sealing region which is less than the diameter of the pipette mounting shaft, a thin resilient annular side wall having a thickness in a range of 0.20 to 0.50 mm and an axial length in a range of 0.25 to 0.65 cm. Thus, while the distal end of the mounting shaft fits into the enlarged open end of the pipette tip, the frusto-conical outer surface of the mounting shaft engages the inner surface of the sealing region at the bottom of the open top of-the pipette tip to stretch the annular sealing region or line radially outward as the mounting shaft is inserted into the proximal portion, thereby creating a fluid tight seal between the sealing zone and the sealing region. In addition to the proximal portion, the improved pipette tip includes a tubular distal portion extending from the mid-portion and terminating in a relatively narrow distal end opening for passing fluid into and from the tip upon operation of the pipette device. Finally, the improved pipette tip preferably includes lateral stabilizing means on its inner surface adjacent the sealing region for engaging the outer surface of the mounting shaft as it is inserted into the proximal portion to laterally stabilize the tip on the shaft. Such lateral stabilizing means preferably comprises at least three circumferentially spaced contacts extending inwardly from the inner surface of the proximal portion of the tip adjacent the sealing region for engaging the outer surface of the mounting shaft as it is inserted into the proximal portion to laterally stabilize the tip on the shaft. In this regard, the diametric spacing of the contacts is such that the contacts lightly engage and allow the distal end of the shaft to pass with no hoop stretching of the sidewalls from which the contacts extend. In this manner, the contacts combine with the sealing region to provide lateral support for the pipette tip on the mounting shaft and prevent the pipette tip from moving laterally when lateral external forces are exerted on the distal portion of the tip as during touching off.

While the "Soft Seal" pipette tip represented a substantial improvement over standard pipette tips with respect to the pipette tip mounting and ejection forces; the more recently developed "LTS" pipette tip and pipette tip mounting shaft system described in U.S. Pat. No. 6,168,761, reduces the risk of repetitive motion injuries to pipette users and minimizes pipette tip mounting and ejection forces to a degree previously thought to be unattainable. Specifically, the LTS system meets the heretofore unattainable ideal criteria that disposable plastic pipette tips (i) be easily mountable on a pipette tip mounting shaft to form a fluid tight connection with the shaft which is so secure that the tip will not rock laterally on or accidentally dislodge from the shaft during normal pipette use and (ii) then be easily ejectable from the mounting shaft by application of minimal axial mounting and ejection forces, e.g. forces approaching one pound or less. To achieve this, the LTS system incorporates in an air displacement pipette the concept of axially spaced annular sealing and substantially cylindrical lateral support zones and regions on the pipette's mounting shaft and tip, respectively. Preferably, the annular sealing region on the pipette tip comprises an annular sealing surface inward of a sidewall of the pipette tip which in the sealing region is sufficiently thin that the sealing region will expand slightly and form an interference fit and air tight seal between the sealing surface and the sealing zone on the mounting shaft when the sealing zone penetrates the sealing region. Further, the LTS system provides means for insuring uniform depth of mounting shaft penetration into the pipette tip to maintain uniform tip interference with the mounting shaft as successive tips are mounted on and ejected from the mounting shaft.

In particular, the LTS system incorporates a combination of a pipette tip mounting shaft and pipette tip in an air displacement pipette wherein the mounting shaft comprises an axially elongated body including a distal end and annular or substantially cylindrical and axially spaced outer surface regions defining an annular sealing zone and an annular lateral support zone. The pipette tip of the LTS system is an elongated tube comprising an open proximal end, an open conical distal end and annular or substantially cylindrical and axially spaced inner surface regions defining an annular sealing region and an annular lateral support region. The outer diameter of the annular sealing zone on the mounting shaft is slightly greater than the inner diameter of the annular sealing region on the pipette tip and the sidewall of the tip in the area of the annular sealing region is sufficiently thin that the annular sealing region expands slightly to form an interference fit and air tight seal between the mounting shaft and the pipette tip when the sealing zone penetrates the sealing region. The axial spacing of the sealing and support zones is substantially equal to the axial spacing of the sealing and support regions. Also, the outer diameter of the lateral support zone is slightly less than the inner diameter of the lateral support region such that as the sealing zone penetrates the sealing region, the support region receives the support zone and provides lateral support therefor which prevents transverse rocking of the pipette tip on the mounting shaft as might otherwise occur during touching off of the pipette tip and an accompanying undesired dislodging of the tip from the shaft.

Further, a preferred form of the LTS system includes the aforementioned controlled interference air tight fit and mating annular lateral support zone and region as well cooperative means on the pipette and pipette tip for limiting the axial travel of the tip on the mounting shaft. This insures uniform depth of mounting shaft penetration into the pipette tip to maintain uniform the desired tip interference with the mounting shaft as successive tips are mounted on and ejected from the mounting shaft and is to be distinguished from the pipette tip shoulder structure of previously mentioned U.S. Pat. No. 4,824,641.

Because of the above described cooperative structural features of the pipette tip and mounting shaft, the LTS system has proven to only require axial pipette tip mounting and ejection forces substantially equal to or less than one pound and to provide a stable air-tight seal of the tip on the shaft which is secure against undesired lateral rocking of the pipette tip on the mounting shaft. Thus, the LTS system requires a pipette user to generate so little hand and thumb force that repeated mounting and ejection of such pipette tips is unlikely to result in repetitive stress injury.

While the LTS system is in the process of revolutionizing the art of mounting and dispensing pipette tips in pipette devices, further development of the LTS system has revealed that similar functional benefits may be achieved with system modifications wherein the annular sealing surface for the LTS system comprises an outwardly directed annular seal located at a lower end of the pipette tip mounting shaft rather than comprising an inwardly projecting annular seal on the pipette tip. That invention is described and claimed in U.S. patent application Ser. No. 09/895,745, filed Jun. 30, 2001.

Still further, in the early stages of research directed to the LTS system, alternative embodiments were proposed, developed and successfully tested which are not disclosed or taught by U.S. Pat. No. 6,168,761. Further analysis of such embodiments has recently revealed that certain of such embodiments possess many of the advantageous characteristics of the patented LTS system. The present patent application is directed to such previously developed and previously undisclosed LTS embodiments.

SUMMARY OF INVENTION

Basically, the present invention comprises a pipette tip and mounting shaft combination in an air displacement pipette. The pipette tip mounting shaft has a radially stepped exterior comprising adjacent substantially cylindrical portions of different diameter and an annular sealing zone including an annular edge seal formed at a radially extending shaft transition such as the transition between the adjacent substantially cylindrical shaft portions or the radial transition at a distal end of the shaft. The pipette tip includes an annular sealing region having an inner sealing surface on a sidewall of the tip which in the sealing region is sufficiently thin as to expand slightly and form an interference fit and air tight seal between the sealing surface and the sealing zone when the sealing zone penetrates the sealing region.

Preferably, the pipette tip-mounting shaft combination of the present invention is characterized by pipette tip insertion and ejection forces of less than two pounds and to insure consistency of such forces includes means for limiting the axial penetration of the shaft into the tip. Such penetration limiting means may, for example, comprise mating stops and shoulders on the shaft and tip designed to limit axial contact between the sealing region and the sealing zone to the edge seal or to a narrow annular band having an axial dimension ranging from between a lower limit defined by a line contact between the sealing region and the edge seal and an upper limit of an axial surface to surface contact between the sealing region and zone of about 0.1 of an inch.

In other embodiments of the present invention, the pipette tip-mounting shaft combination may include an annular lateral support region on an inner surface of the pipette tip for mating with an annular lateral support zone on an outer surface of the mounting shaft to prevent undesired lateral rocking of the tip on the shaft, as during touching off. In one such embodiment, the lateral support zone on the mounting shaft may have an outer diameter slightly greater than an inner diameter of the lateral support region on the pipette tip and a sidewall of the pipette tip in the lateral support region may be sufficiently thin as to expand slightly to form an interference fit and even a secondary air tight seal between the mounting shaft and pipette tip when the support zone penetrates the support region.

DETAILED DESCRIPTION OF INVENTION

Figure 1:
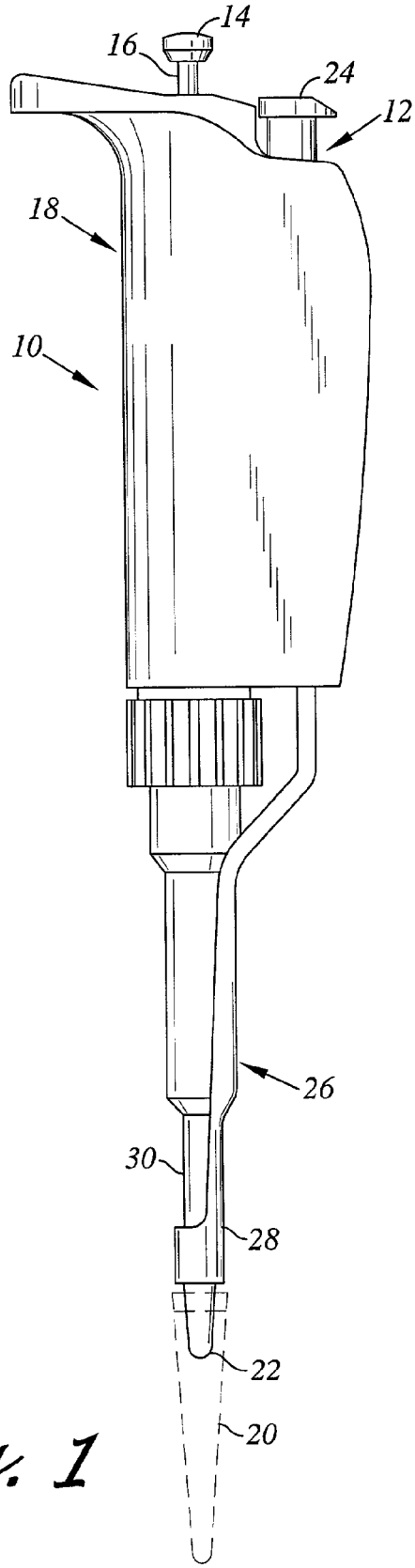
FIG. 1 is a side view of a standard manual pipette having a pipette tip mounted on a mounting shaft adjacent a lower end of a tip ejector mechanism of the pipette.

FIG. 1 illustrates a standard manual pipette resembling the PIPETMAN pipette sold exclusively in the United States by the Rainin Instrument Co. Inc., assignee of the present invention. The manual pipette is designated in FIG. 1 by the number 10 and includes a pipette tip ejector mechanism 12 described in U.S. Pat. No. 3,991,617 issued Nov. 16, 1976, which is incorporated herein by this reference.

The pipette 10 comprises a push button 14 connected by a rod 16 to a piston (not shown) located in the body or housing 18 of the pipette. The push button 14 may be depressed by a user exerting a downward force on the push button to cause downward movement of the piston of the pipette. When the push button 14 is released, a quantity of liquid to be sampled is sucked into a disposable pipette tip 20 releasably secured to a lower end of a pipette tip mounting shaft 22 of the pipette. The sample then may be transferred into another vessel by once more exerting a downward force on the push button 14. After such use, it is common practice to eject the pipette tip 20 from the mounting shaft 22 and replace it with a new pipette tip for repeated operation of the pipette 10 in aspirating and dispensing a new sample fluid.

The pipette tip ejector mechanism 12 is employed to eject the tip 20 from the mounting shaft 22. In this respect, the mechanism 12 comprises a push button 24 connected to a rod located in a passage (not shown) provided in an upper part of the hand holdable housing 18 of the pipette 10. The passage and rod are arranged so as to be able to impart to the rod a movement of translation parallel to an axis of the pipette in opposition to a spring (not shown) normally urging the rod in an upward position. A removable tip ejector member or arm 26 including a tubular upper end extends from a lower end of the rod and from the rod follows the general exterior contour of the housing 18 of the pipette to terminate in a sleeve 28. The sleeve 28 encircles a conical lower end 30 of the pipette tip mounting shaft 22 which tightly receives the upper end of the disposable pipette tip 20. To eject the pipette tip 20 from the lower end of the mounting shaft 22, a user grips the pipette housing 18 and using his or her thumb presses downward on the push button 24. The downward force on the push button is translated by the rod to the tip ejector arm 26 and hence to the sleeve 28 which presses down on an upper end of the pipette tip. When the downward force transferred by the sleeve 28 exceeds the friction between the pipette tip 20 and the mounting shaft 22, the pipette tip is propelled from the mounting shaft. Upon a release of the push button 24, the spring returns the tip ejector mechanism 12 to its normal position with the sleeve spaced slightly from the upper end of a replacement pipette tip which is inserted onto the mounting shaft 22 readying the pipette 10 for its next aspiration and dispensing operation.

As previously stated, for standard small and moderate volume pipettes, the pipette tip mounting shaft 22 has an inward axial taper of between two and five degrees from the longitudinal axis of the mounting shaft. As also previously stated, standard small and moderate volume pipettes tips for use with such standard pipette tip mounting shafts include a relatively long frusto-conical annular sealing band or inner surface contiguous with the open proximal end of the tip for engaging and sealing with the frusto-conical distal end of the pipette tip mounting shaft to provide lateral stability for the tip on the shaft. The angle of taper of the sealing surface is usually within about one degree of the two to five degrees inward taper of the mounting shaft and the length of the sealing surface on the shaft is such that in forming the annular seal the tip is also fairly stable on the shaft. In forming the desired annular seal, the frusto conical annular sealing region along with the balance of the open proximal end of the pipette tip is required to stretch like a hoop outwardly normal to the mating sloping surface of the pipette tip mounting shaft. Because of the length of the sealing region and the relatively thick sidewall of the standard tip, large plastic forces in the tip material resist such outward hoop stretching. Such plastic forces must be overcome and require the pipette user to exert large axial forces on the tip in order to mount the tip on the mounting shaft and create the necessary annular fluid tight seal therebetween. Often, axial forces between 8 and 15 pounds are required to mount a standard pipette tip on a standard mounting shaft and create the desired fluid tight seal. Such axial forces are generated by the hand and forearm of a pipette user during insertion of the pipette tip mounting shaft into the pipette tip, which is usually held in a pipette tip mounting rack. Of course, when it is desired to eject such a firmly mounted tip from a pipette tip mounting shaft, an axial force of approximately ten (10) pounds must be exerted on the upper edge of the pipette tip to overcome the friction forces between the pipette tip and shaft and to eject the tip from the shaft.

As previously described, the downward tip ejection forces are exerted by the pipette user pressing downward with his or her thumb on the top of the push button 24 to translate axial force through the ejector arm 26 to the top of the pipette tip 20. As previously stated, to eject the standard pipette tip from its associated mounting shaft requires the pipette user to generate an axial ejection force of about 10 pounds. Over the course of several repeated ejection operations, the thumb and hand of the user will become physically stressed. This often results in repetitive motion injury to the thumb and hand and in extreme cases carpal tunnel syndrome.

It is a major purpose of the present invention to significantly reduce and if possible eliminate such repetitive motion injuries. In accordance with that purpose, the present invention provides a novel mounting shaft and pipette tip combination which allows for the easy yet firm mounting of the pipette tip of the present invention on its associated mounting shaft and the easy ejection of the pipette tip from the mounting shaft by the application of axial mounting and ejection forces of less than two pounds.

Figure 2:
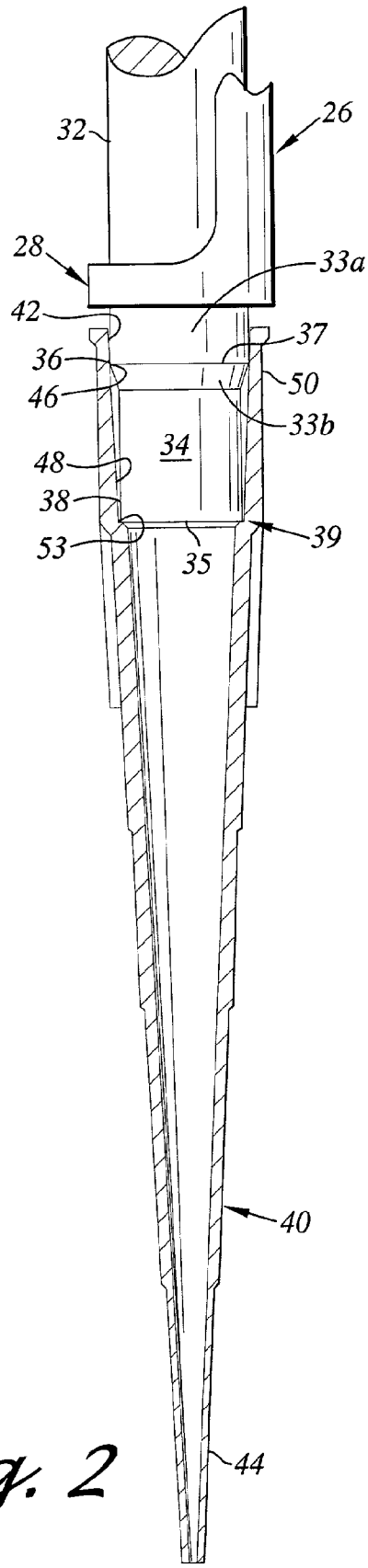
FIG. 2 is a cross sectional side view of a first embodiment of the pipette tip and mounting shaft combination of the present invention including (i) a radially stepped pipette tip mounting shaft comprising adjacent upper and lower substantially cylindrical portions of different diameter and including an outer annular sealing zone comprising an annular edge seal formed at a junction of an outermost edge of a radially extending shaft transition and a lower end of the upper substantially cylindrical portion of the shaft, (ii) a pipette tip including an inner annular sealing surface defining a sealing region mating with the sealing zone and having a sidewall which is sufficiently thin as to expand and form a fluid tight seal with the annular edge seal as the sealing zone penetrates the sealing region, (iii) the mating relationship of a lower lateral support region and a lower lateral support zone on the tip and shaft respectively, and (iv) a first embodiment of an axial penetration limiting means including an annular shoulder on the pipette tip for limiting mounting shaft penetration into the tip.
Figure 3:
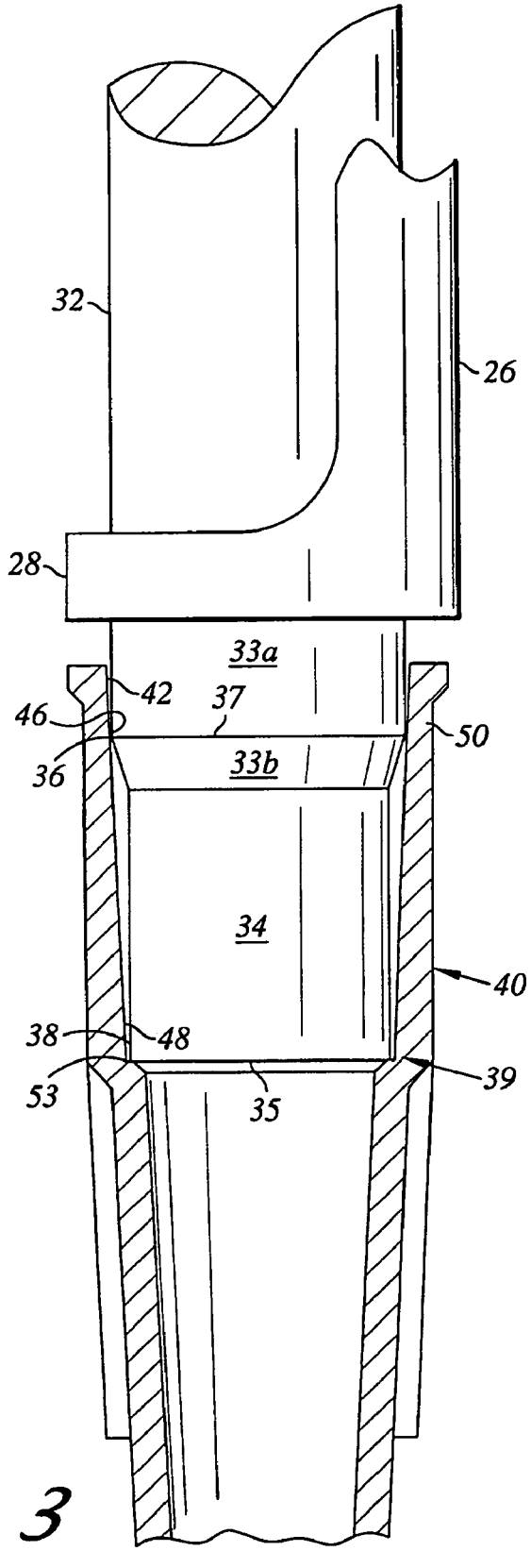
FIG. 3 is an enlarged fragmentary sectional side view of an upper portion of the pipette tip and mounting shaft combination of FIG. 2 showing (i) the fluid tight seal between the sealing region and sealing zone, (ii) the mating relationship of the lower lateral support region and the lower lateral support zone shown in FIG. 2, and (iii) the first embodiment of an axial penetration limiting means shown in FIG. 2.

A preferred embodiment of the structure of the pipette tip and mounting shaft combination of the present invention is depicted in FIG. 2 and shown in enlarged detail in FIG. 3. As there illustrated, the combination comprises a pipette tip mounting shaft 32 and a pipette tip 40. The mounting shaft 32 preferably comprises an axially elongated body including an upper substantially cylindrical portion 33*a* having a first diameter and a substantially cylindrical lower distal end portion 34 having a second diameter less than the first diameter. The upper portion 33*a* is designed to extend vertically downward from an associated pipette, such as 10 in FIG. 1. In the illustrated version of the mounting shaft 32, the lower distal end portion 34 steps radially inward from the upper portion 33*a* at a radially extending shaft transition 33*b*, here illustrated as being of a frusto conical shape comprising an inverted frustum of a cone.

As depicted in FIGS. 2 and 3, the outer surfaces of the upper and lower distal portions of the mounting shaft 32 preferably comprise annular or substantially cylindrical and axially spaced outer surface regions defining an annular sealing zone 36 including an annular edge seal 37 at an outermost edge of the shaft transition 33*b* and an annular lateral support zone 38 on the distal end portion 34 at or adjacent the lower end 35 of the shaft 32. Specifically, in the embodiment of FIGS. 2 and 3, the edge seal 37 is formed at a junction of the outermost edge of the transition 33*b* and the lower end of the upper substantially cylindrical portion 33*a* of the shaft 32.

As is also depicted in FIGS. 2 and 3, the pipette tip 40 of the illustrated combination is an elongated plastic tube comprising an open proximal end 42 and an open conical distal end 44. Like the mounting shaft 32, the pipette tip 40 also comprises annular or substantially cylindrical and axially spaced inner surface regions defining an annular sealing region 46 and an annular lateral support region 48 for mating with the sealing and support zones 36 and 38 respectively, on the mounting shaft. As used herein, "substantially cylindrical" means an annular surface having an axial taper of one and one-half degrees or less.

In addition, the embodiment of the pipette tip and mounting shaft combination shown in FIGS. 2 and 3 illustrates a first embodiment of an axial penetration limiting means 39 for limiting penetration of the shaft 32 into the tip 40. Specifically, the means 39 is designed to limit axial contact between the sealing region 46 and the sealing zone 36 to a narrow annular band comprising the annular edge seal 37. In this regard, while restricting the axial contact to the annular edge seal 37 results in minimum axial forces being required to mount and eject the tip 40 on and from the mounting shaft 32, a range of axial contact has been found to be operationally satisfactory and comprises as a lower limit a line contact between the sealing region and the edge seal and an upper limit comprising the edge seal and an axial surface to surface contact between the sealing region and sealing zone of about 0.1 of an inch. In the embodiment of FIGS. 2 and 3, the penetration limiting means 39 comprises an annular, upwardly facing, inwardly directed shoulder 53 on the inner surface of the pipette tip 40 immediately adjacent the lateral support region 48. The shoulder 53 is designed such that an upper surface thereof engages a downwardly facing surface such as the bottom 35 of the distal end 34 of the mounting shaft 32 at an outer circumferential portion thereof.

Figure 6:
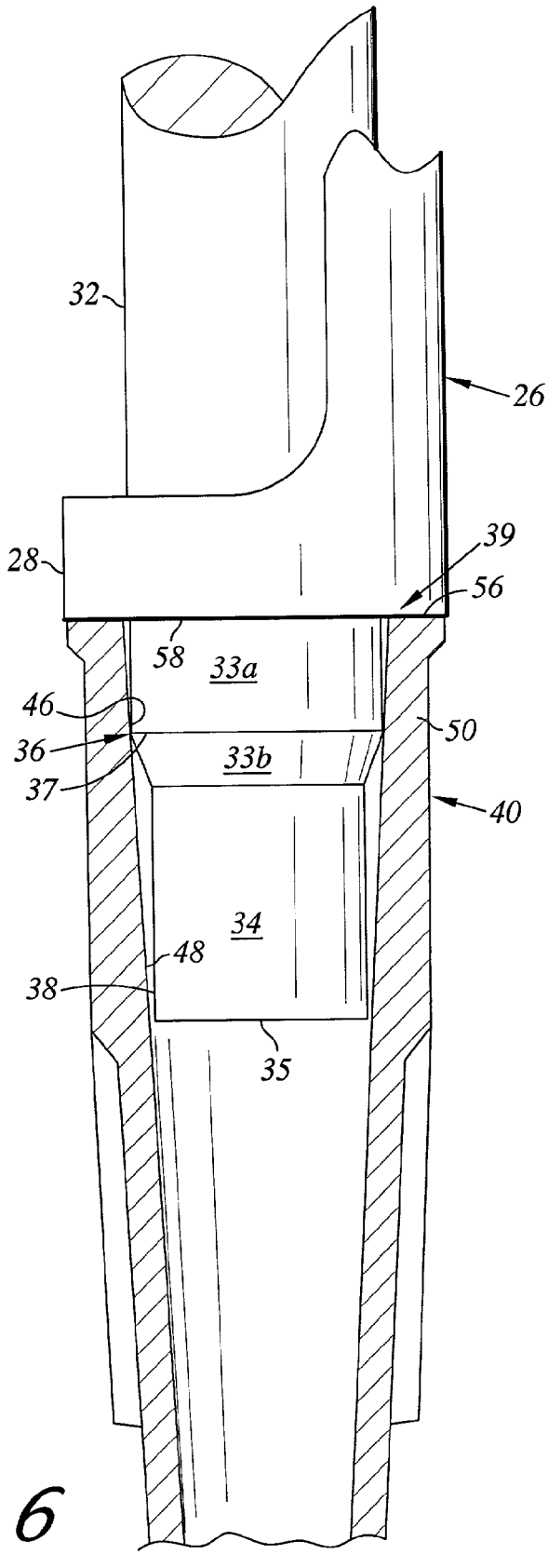
FIG. 6 is an enlarged sectional side view similar to FIG. 3 in addition showing a first alternative embodiment of the axial penetration limiting means including a lower end of the pipette tip ejector of a pipette for limiting mounting shaft penetration into the tip.
Figure 7:
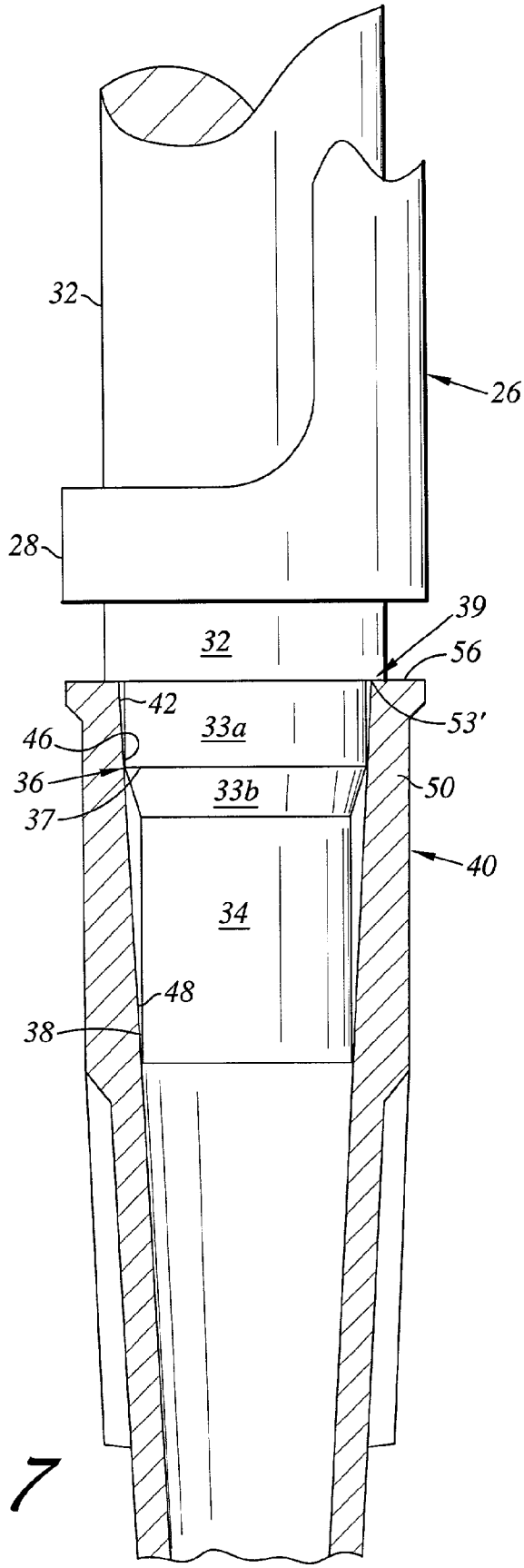
FIG. 7 is an enlarged fragmentary side view similar to FIG. 3 in addition showing a second alternative embodiment of the axial penetration limiting means including a shoulder on the pipette tip mounting shaft for limiting mounting shaft penetration into the tip.

Alternate embodiments of the penetration limiting means 39 are depicted in FIG. 6 and FIG. 7. In FIG. 6, the means 39 is depicted as comprising a bottom 58 of the sleeve 28 of the pipette tip ejector mechanism 26 illustrated and described with respect to FIG. 1. When the bottom surface 58 engages the upper annular edge 56 of the pipette tip 40, further penetration of the mounting shaft 32 into the pipette is halted. In FIG. 7, the means 39 comprises an outwardly directed downwardly facing annular shoulder 53' on the upper portion 33*a* of the pipette tip mounting shaft 32 which upon insertion of the shaft into the open proximal end 42 of the tip engages the upper annular edge 56 of the tip to halt further penetration of the shaft into the tip.

It should be noted that all versions of the penetration limiting means 39 also function to insure uniform depth of mounting shaft penetration into the pipette tip to maintain uniform tip interference with the mounting shaft as successive tips are mounted on and ejected from the mounting shaft.

As is also illustrated in FIGS. 2 and 3, the outer diameter of the sealing zone 36 comprising the annular edge seal 37 is slightly greater than the inner diameter of the annular sealing region 46 on the inner surface of the pipette tip 40. This applies for each of the embodiments of the present invention including those depicted in FIGS. 4–7. Also, the sidewall 50 of the tip in the area of the annular sealing region 46 is sufficiently thin that the annular sealing region expands slightly to form an interference fit and air tight seal between the mounting shaft 32 and the pipette tip 40 when the sealing zone 36 penetrates the sealing region 46. In practice, it has been found that the desired interference fit is formed when the difference in the outer diameter of the annular sealing zone and the inner diameter of the annular sealing region is at least 0.05 millimeters (mm). Further, it has been found that in practice that the wall thickness of the pipette tip in the area of the sealing region 46 is preferably between 0.20 and 0.50 mm.

As further illustrated in FIGS. 2 and 3, the axial spacing of the sealing and support zones (36,38) on the mounting shaft 32 is substantially equal to the axial spacing of the support zone and region (46,48) on the pipette tip 40. Also, the outer diameter of the lateral support zone 38 is slightly less than the inner diameter of the lateral support region 48. Thus, as the sealing zone 36 penetrates the sealing region 46, the support region 48 receives the support zone 38 and provides lateral support therefor which prevents transverse rocking of the pipette tip 40 on the mounting shaft 32 as might otherwise occur during "touching off" of the pipette tip and an accompanying undesired dislodging of the tip from the shaft. In these regards, it is preferred that the axial spacing of the mating lateral support zone 38 and region 48 from the sealing zone and region 36,46 is substantially equal to the inner diameter of the pipette tip 40 in the support region. Such a length relationship provides excellent lateral stability for the pipette tip 40 on the mounting shaft 32.

Figure 4:
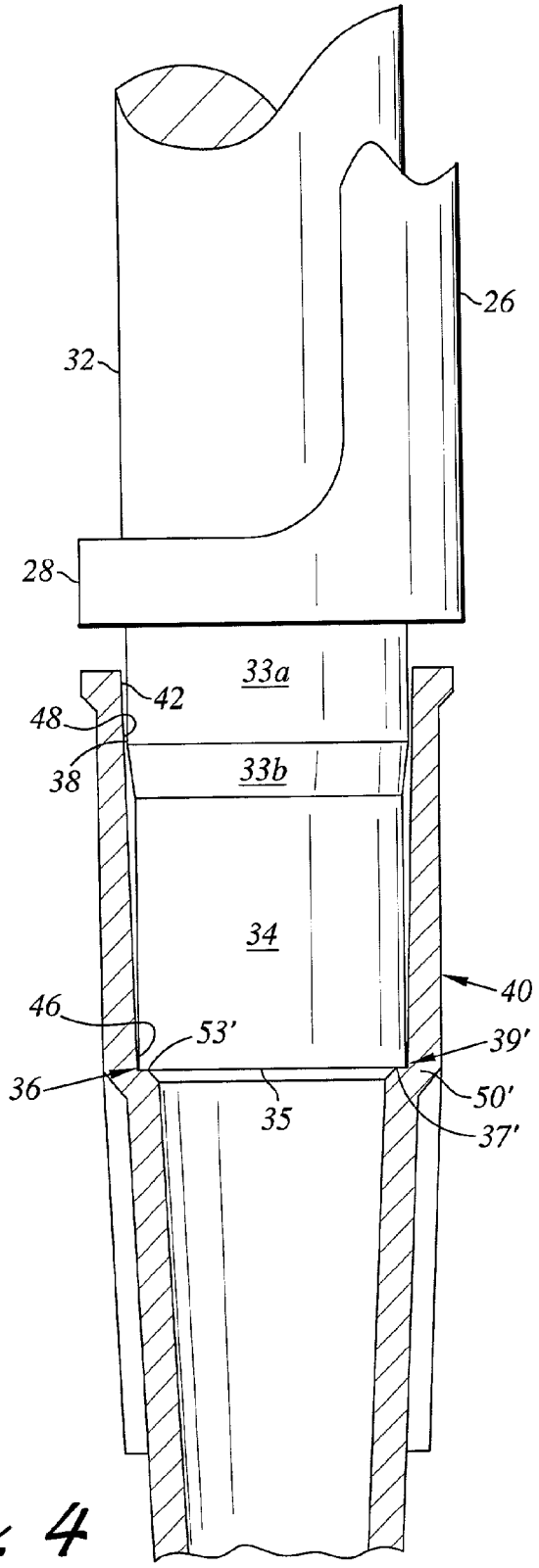
FIG. 4 is an enlarged fragmentary sectional side view of an upper portion of a second embodiment of the pipette tip and mounting shaft combination of the present invention showing (i) a lower fluid tight seal between an inner sealing region on the tip adjacent and immediately above the annular shoulder and an annular outer sealing zone comprising an annular edge seal at an outermost edge of a radially extending shaft transition comprising a lower end of the shaft, (ii) the mating relationship of an upper lateral support region on the tip and an upper lateral support zone on the shaft, and (iii) the first embodiment of the axial penetration limiting means depicted in FIG. 3.

Each of the foregoing features of the pipette tip and mounting shaft combination of the present invention described with respect to the embodiment of FIGS. 2 and 3 are also present in the embodiment illustrated in FIG. 4. However, the embodiment of FIG. 4 differs from that of FIGS. 2 and 3 in that the sealing and lateral support zones 36 and 38 on the shaft 32 are inverted as are the sealing and lateral support regions 46 and 48 on the tip 40. Specifically, as illustrated in FIG. 4, the sealing zone 36 comprises the edge seal 37' which is formed by the outermost edge of the lowermost surface 35 of the distal end portion 34 of the shaft 32, the surface 35 defining a radially extending transition on the shaft. As illustrated, the outer diameter of the sealing zone 36 on the shaft 32 of FIG. 4 is slightly greater than the inner diameter of the inner annular sealing region 46 on the tip 40. Also, the sidewall 50' of the tip in the area of the annular sealing region 46 is sufficiently thin that the annular sealing region expands slightly to form an interference fit and air tight seal between the mounting shaft 32 and the pipette tip 40 when the sealing zone 36 penetrates the sealing region 46.

In addition, the embodiment of FIG. 4 includes an axial penetration limiting means 39' like the means 39 in FIG. 3. As in the embodiment of FIG. 3, the penetration limiting means 39' limits the axial contact between the sealing region 46 and the sealing zone 36 to a narrow annular band comprising the annular edge seal 37'. Such limited axial contact results in minimum axial forces being required to mount and eject the tip 40 on and from the mounting shaft 32. In this regard, as with the embodiment of FIG. 3, a range of axial contact has been found to be operationally satisfactory and comprises as a lower limit a line contact between the sealing region and the edge seal and an upper limit comprising the edge seal and an axial surface to surface contact between the sealing region and sealing zone of about 0.1 of an inch. In the embodiment of FIG. 4, the penetration limiting means 39' comprises an annular, upwardly facing, inwardly directed shoulder 53' on the inner surface of the pipette tip 40 immediately adjacent the lateral support region 48. The shoulder 53' is designed such that an upper surface thereof engages a downwardly facing surface such as the bottom 35 of the distal end 34 of the mounting shaft 32 at an outer circumferential portion thereof. Also, as with the embodiment of FIG. 3, the alternate penetration means 39 of FIGS. 6 and 7 may be utilized as the means 39'.

Further, as to the embodiment of FIG. 4, the axial spacing of the sealing and support zones (36,38) on the mounting shaft 32 is substantially equal to the axial spacing of the support zone and region (46,48) on the pipette tip 40. Also, the outer diameter of the lateral support zone 38 is slightly less than the inner diameter of the lateral support region 48 such as the sealing zone 36 penetrates the sealing region 46, the support region 48 receives the support zone 38 and provides lateral support therefor which prevents transverse rocking of the pipette tip 40 on the mounting shaft 32 as might otherwise occur during "touching off" of the pipette tip and an accompanying undesired dislodging of the tip from the shaft.

Figure 5:
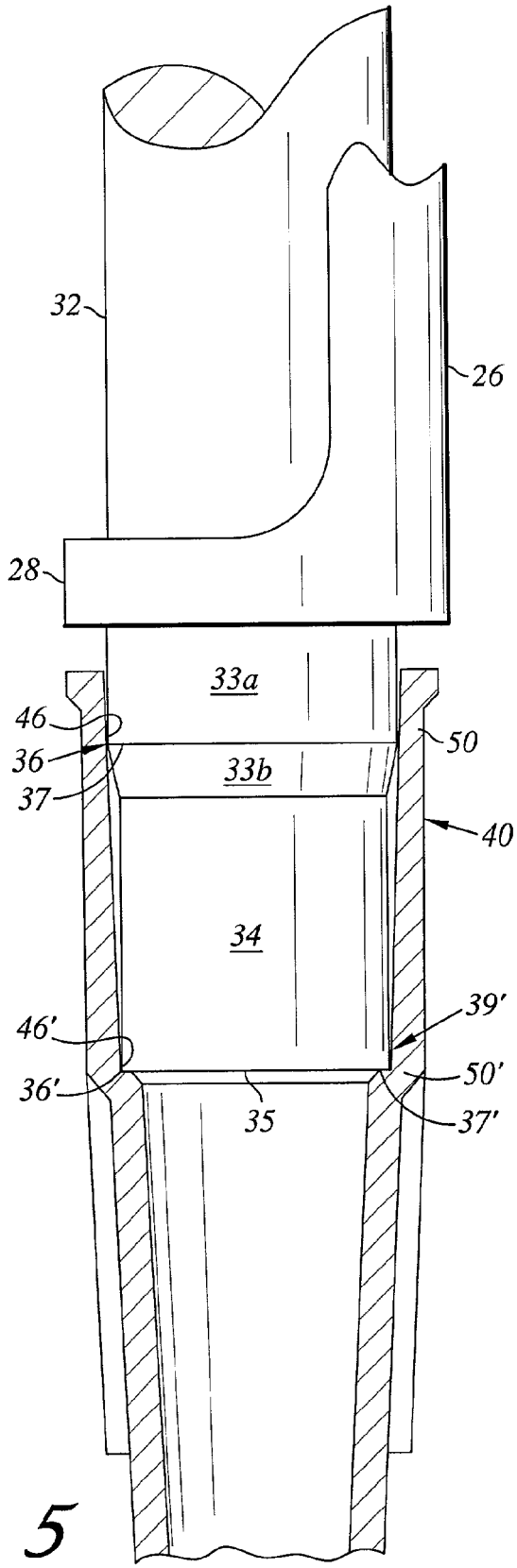
FIG. 5 is an enlarged fragmentary side view of a distal end portion of a third embodiment of the pipette tip mounting shaft combination of the present invention combining the upper and lower annular seals of the first and second embodiments of FIGS. 3 and 4.

Finally, as to the embodiment illustrated in FIG. 5, the features of the embodiments of FIGS. 3 and 4 are combined to provide for a primary and a secondary seal between the shaft 32 and the tip 40. In this regard, for the sake of illustration only, the primary seal may be considered as being the seal formed in the embodiment of FIG. 3 while the secondary seal may be considered as being seal formed in the embodiment of FIG. 4, even thought the reverse may be implemented if desired. Thus, in the embodiment of FIG. 5, the primary seal is designated by the sealing zone 36 and the sealing region 46 while the secondary seal is designated by the sealing zone 36' and the sealing region 46'. In the sealing zone 36, the edge seal is noted as 37 while in the sealing zone 36' the edge seal is noted as 37'. With the combination of the primary and secondary seals, the function of lateral support for the pipette tip 40 on the shaft 32 is provided by the sealing zone 36' and the sealing region 46' while the axial penetration limiting means is the means 39' illustrated in FIG. 4, alternate versions of the means 39 being as illustrated in FIGS. 6 and 7.

As to the embodiment of FIG. 5, the axial spacing of the sealing zones 36 and 36' on the shaft 32 is substantially equal to the axial spacing of the sealing regions 46 and 46' on the inner surface of the tip 40. Thus, as the shaft 32 penetrates the tip 40, the sealing zone 36 mates with the sealing region 46 as the sealing zone 36' mates with the sealing region 46' to create the primary and secondary seals and the desired lateral support for the tip on the shaft. In these regards, the outer diameters of the sealing zones 36 and 36' comprising the annular edge seals 37 and 37' are slightly greater than the inner diameter of the annular sealing regions 46 and 46' respectively. Also, the sidewalls 50 and 50' of the tip 40 in the areas of the sealing regions 46 and 46' are sufficiently thin as to expand slightly and form air tight seals between the annular bands comprising the annular edge seals 37 and 37' and mating inner surfaces of the sealing regions 46 and 46', the penetration limiting means 39' insuring that the narrow annular sealing bands are at the lower limit of the range of axial contact or within the range bounded by the lower limit and the upper limit comprising an axial surface to surface contact of about 0.1 of an inch between the sealing zones and regions (36, 46 and 36' and 46'). Thus, in the embodiment of FIG. 5, the pipette tip-mounting shaft combination is equivalent to the structure of FIG. 3 wherein, however, the lateral support zone 38 on the distal end portion 34 of the shaft 32 has an outer diameter slightly greater than the inner diameter of the lateral support region 48 on the tip 40 and the sidewall of the tip in the lateral support region is sufficiently thin as to expand slightly for form a secondary air tight seal between the shaft and the tip when the support zone 38 penetrates the support region 48. Also, the pipette tip-mounting shaft combination is equivalent to the structure of FIG. 4, wherein, however, the lateral support zone 38 on the proximal or upper end portion 33*a* of the shaft has an outer diameter slightly greater than the inner diameter of the lateral support region 48 on the tip 40 and the sidewall of the tip in the lateral support region is sufficiently thin as to expand slightly to form a secondary air tight seal between the shaft and the tip when the support zone 38 penetrates the support region 48.

While in the foregoing, particular preferred embodiments of pipette tipand mounting shaft combinations in pipettes of the present invention have been described and illustrated in detail, changes and modifications may be made without departing from the spirit of the present invention. Accordingly the present invention is to be limited in scope only by the following claims.

What is claimed is:

1. A pipette tip and mounting shaft combination in an air displacement pipette, the combination comprising:

a pipette tip mounting shaft having a radially stepped exterior comprising adjacent substantially cylindrical portions of different diameter and an annular sealing zone including an annular edge seal formed at a junction of a lower end of one of the substantially cylindrical portions and an outermost edge of a radially extending shaft transition;

a pipette tip including an annular sealing region having an inner sealing surface on a sidewall of the tip which in the sealing region is sufficiently thin as to expand slightly and form an interference fit and air tight seal between the sealing surface and the sealing zone when the sealing zone penetrates the sealing region; and axial penetration limiting means for limiting penetration of the shaft into the tip to limit axial contact between the sealing region and the sealing zone to a narrow annular band comprising the annular edge seal.

2. The pipette tip-mounting shaft combination of claim 1 wherein the narrow annular band has an axial dimension ranging from between a lower limit defined by a line contact between the sealing region and the edge seal and an upper limit comprising the annular edge seal and an axial surface to surface contact between the sealing region and zone of about 0.1 of an inch.

3. The pipette tip-mounting shaft combination of claim 1 wherein the shaft transition comprises a transition between the adjacent substantially cylindrical shaft portions.

4. The pipette tip-mounting shaft combination of claim 1 wherein the substantially cylindrical portions comprise upper and lower substantially cylindrical portions of the shaft and the shaft transition comprises a lower end surface of the lower substantially cylindrical shaft portion.

5. The pipette tip-mounting shaft combination of claim 1 further including an annular lateral support region on an inner surface of the pipette tip for mating with an annular lateral support zone on an outer surface of the mounting shaft to prevent undesired lateral rocking of the tip on the shaft, as during touching off.

6. The pipette tip-mounting shaft combination of claim 5 wherein the lateral support zone on the mounting shaft has an outer diameter slightly greater than an inner diameter of the lateral support region on the pipette tip and a sidewall of the pipette tip in the lateral support region is sufficiently thin as to expand slightly to form a secondary air tight seal between the mounting shaft and pipette tip when the support zone penetrates the support region.

7. An air displacement pipette comprising:

an axially elongated pipette tip mounting shaft including a first substantially cylindrical portion having a first diameter, a second substantially cylindrical portion substantially coaxial with and below the first portion and having a second diameter less than the first diameter, a radially extending shaft transition, and an annular sealing zone on the shaft comprising an annular edge seal formed at a junction of a lower end of one of the first and second substantially cylindrical portions and an outermost edge of the shaft transition; and a hollow axially elongated pipette tip including an open end for receiving the second and first portions of the shaft, a first substantially cylindrical portion below and substantially coaxial with the open end and having an inner annular sealing region for mating with the annular sealing zone and in the sealing region having a sidewall which is sufficiently thin as to expand and create a fluid tight seal between the sealing zone and region as the sealing zone penetrates the sealing region during a mounting of the pipette tip on the mounting shaft, and a second portion below the first portion of the tip and including a relatively small open end for passing fluid into and from the pipette tip during operation of the pipette; and axial penetration limiting means for limiting axial penetration of the shaft into the tip to limit axial contact between the sealing region and the sealing zone to a narrow annular band comprising the annular edge seal.

8. The pipette of claim 7 wherein the narrow annular band has an axial dimension ranging from between a lower limit defined by a line contact between the sealing region and the annular edge seal and an upper limit comprising the annular edge seal and an axial surface to surface contact between the sealing region and zone of about 0.1 of an inch.

9. The pipette of claim 7 wherein the shaft transition comprises a portion of the shaft between the first and second portions of the shaft.

10. The pipette of claim 7 wherein the shaft transition comprises an inverted frustum of a cone between the first and second portions of the shaft.

11. The pipette of claim 7 wherein the shaft transition comprises a lower end surface of the second substantially cylindrical portion of the shaft.

12. The pipette of claim 7 wherein the axial penetration limiting means comprises an interior shoulder on the tip for engaging a stop surface on the shaft.

13. The pipette of claim 7 wherein the axial penetration limiting means comprises an exterior stop on the shaft for engaging a stop surface on the tip.

14. The pipette of claim 7 wherein the means for limiting axial penetration comprises a stop surface on a tip ejector for the pipette for engaging a stop surface on the tip.

15. The pipette of claim 7 further comprising means for maintaining vertical alignment of the tip on the shaft.

16. The pipette of claim 15 wherein the means for maintaining vertical alignment of the tip on the shaft comprises an annular lateral support zone on an outer surface of the second portion of the shaft and a substantially cylindrical lateral support region on an inner surface of the first portion of the tip axially spaced from the sealing region for engaging the lateral support zone upon a lateral rocking of the tip on the shaft.

17. The pipette of claim 16 wherein the lateral support zone on the mounting shaft has an outer diameter slightly greater than an inner diameter of the lateral support region on the pipette tip and a sidewall of the pipette tip in the lateral support region is sufficiently thin as to expand slightly to form a secondary air tight seal between the mounting shaft and pipette tip when the support zone penetrates the support region.

* * * * *